United States Patent [19]

Kohama et al.

[11] 4,109,462

[45] Aug. 29, 1978

[54] DEVICE FOR PURIFYING EXHAUST GAS DISCHARGED FROM INTERNAL COMBUSTION ENGINE

[75] Inventors: Tokio Kohama, Nishio; Hideki Obayashi, Aichi; Tadashi Ozaki, Nishio; Hidetaka Nohira, Susono, all of Japan

[73] Assignees: Nippon Soken, Inc., Nishio; Toyota Jidosha Kogyo Kabushiki Kaisha, Toyota, both of Japan

[21] Appl. No.: 744,823

[22] Filed: Nov. 24, 1976

[30] Foreign Application Priority Data

Dec. 25, 1975 [JP] Japan ..... 50/157240

[51] Int. Cl.[2] ..... F02M 25/06

[52] U.S. Cl. ..... 60/278; 60/292; 123/119 A

[58] Field of Search ..... 60/278, 292; 123/97 B, 123/119 A

[56] References Cited

U.S. PATENT DOCUMENTS

| | | | |
|---|---|---|---|
| 3,368,345 | 2/1968 | Walker | 60/278 |
| 3,523,418 | 8/1970 | Marsee | 60/292 |
| 3,928,966 | 12/1975 | Goto | 60/278 |
| 3,973,535 | 8/1976 | Sugihara | 123/119 A |

*Primary Examiner*—Douglas Hart

*Attorney, Agent, or Firm*—Cushman, Darby & Cushman

[57] ABSTRACT

Disclosed is an improvement of an exhaust gas purifying device for use with an internal combustion engine incorporating both an exhaust gas recirculation system and a secondary air supply system, the improvement comprising variable restriction means disposed in an exhaust pipe downstream of an exhaust gas intake port of the exhaust gas recirculation system for varying the flow cross sectional area of the exhaust pipe and control means responsive to the difference between the signal representative of the volume of exhaust gas and the signal representative of the volume of intake air for controlling the variable restriction means in such a way that the former signal may be proportional to the latter signal, whereby the volume of exhaust gas to be recirculated may be made optimumly proportional to the volume of intake air independently of the variation in rotational speed and load of the engine.

13 Claims, 10 Drawing Figures

DEVICE FOR PURIFYING EXHAUST GAS DISCHARGED FROM INTERNAL COMBUSTION ENGINE

BACKGROUND OF THE INVENTION

The present invention relates to generally an exhaust gas purifying device for use with an internal combustion engine and more particularly an improvement of an exhaust gas recirculation system.

In the conventional exhaust gas recirculation systems, a part of exhaust gas is recirculated from an exhaust system into an intake system downstream of a venturi of a carburetor but upstream of a throttle valve through a fixed restriction in a volume which is a function of the back pressure in the exhaust system. In the conventional secondary air supply systems, the air discharged from an air pump is injected into the exhaust pipe through an air bypass valve for discharging the secondary air in case of deceleration, a relief valve for discharging the secondary air into the surrounding atmosphere when the discharge pressure of the air pump is high in order to improve the service life of the air pump and a check valve for preventing the flow of exhaust gas into the air pump. Under the normal conditions, all of the air discharged from the air pump is injected into the exhaust pipe. The exhaust gas recirculation system and the secondary air supply system are controlled independently of each other.

With the secondary air supply systems of the type described, the air discharged from the air pump is all injected into the exhaust pipe under normal conditions so that the volume of secondary air supply relative to the volume of intake air increases and decreases under light and heavy load. Since the ratio of the volume of secondary air supply to the volume of intake air varies depending upon load, the back pressure is deviated from the relation that the back pressure is proportional to the square of the volume of intake air. Furthermore the back pressure varies not only with load but also with the decrease in performance of the air pump. If the secondary air supply system is not incorporated, the relation between the negative pressure at a venturi in a carburetor which pressure is a function of the volume of intake air and the back pressure in the exhaust system is linear. Therefore when a part of exhaust gas is recirculated from the exhaust system into the intake system downstream of the restriction but upstream of the throttle valve, the volume of exhaust gas recirculated is in proportion to the volume of intake air. However, when the secondary air supply system including the air pump driven by the engine is incorporated, the linear relation between the back pressure and the negative pressure at the venturi in the carburetor is lost and consequently the volume of exhaust gas to be recirculated is not in proportion to the volume of intake air because the volume of secondary air supply is in proportion to the rotational speed of the engine whereas the volume of intake air varies with the variation not only in rotational speed of the engine but also in load.

As a result, in the conventional exhaust gas purifying device incorporating both the exhaust gas recirculation system and the secondary air supply system, the volume of exhaust gas to be recirculated is not in proportion to the volume of intake air. As a consequence, with light load the ratio of the volume of exhaust gas to be recirculated to the volume of intake air increases excessively so that the engine operation is adversely affected. With heavy load the ratio decreases excessively so that the satisfactory elimination of NOx cannot be attained. Furthermore the exhaust gas to be recirculated contains the secondary air injected into the exhaust system so that the air-fuel ratio which is set by the carburetor changes.

SUMMARY OF THE INVENTION

In view of the above, one of the objects of the present invention is to provide an improvement of an exhaust gas purifying device of the type incorporating both an exhaust gas recirculation system and a secondary air supply system, wherein the volume of exhaust gas to be recirculated is always in optim proportion with the volume of intake air independently of variation in load.

To the above and other ends, the present invention provides an exhaust gas purifying device for use with an internal combustion engine, said device including a secondary air supply system for supplying secondary air into an exhaust system of the engine and an exhaust gas recirculation system for branching a part of exhaust gas through an exhaust gas intake port opened into the exhaust system and recirculating the branched exhaust gas through a recirculation passage into an intake system of the engine, variable restriction means disposed in the exhaust system downstream of the exhaust gas intake port for varying the flow cross sectional area of the exhaust system and control means for comparing the signal representative of the volume of exhaust gas with the signal representative of the volume of intake air and controlling the variable restriction means in response to the result of comparision in such a way that the signal representative of the volume of exhaust gas may be made proportional to the signal representative of the volume of intake air.

Another object of the present invention is to prevent the entrainment of secondary air into the exhaust gas to be recirculated. According to the present invention, this object is accomplished by having the exhaust gas intake port opened into one of the exhaust branches of the exhaust system which is not supplied with the secondary air.

A further object of the present invention is to eliminate the adverse effects on the performance of the engine of the variable restriction means. According to the present invention, this object is accomplished by the disposition of the variable restriction means in said one exhaust branch into which is opened the exhaust gas intake port.

The above and other objects, features and advantages of the present invention will become more apparent from the following description of four preferred embodiments thereof taken in conjunction with the accompanying drawings.

BRIEF DESCRIPTION OF THE DRAWINGS

Same reference numerals are used to designate similar parts throughout figures.

DESCRIPTION OF THE PREFERRED EMBODIMENTS

Prior to the description of the preferred embodiments of the present invention, the relation between the volume of exhaust gas to be recirculated and the volume of intake air in an exhaust gas recirculation system of an internal combustion engine will be described. When a secondary air supply system is not provided, the negative pressure at a venturi in a carburetor is a function of the volume of intake air and is expressed by the following relation:

$$Q = C.A \sqrt{\Delta P}$$

where

Q = volume of intake air,

C = flow coefficient,

A = cross sectional area of venturi, and $\Delta P$ = absolute value of negative pressure at venturi.

Figure 8:
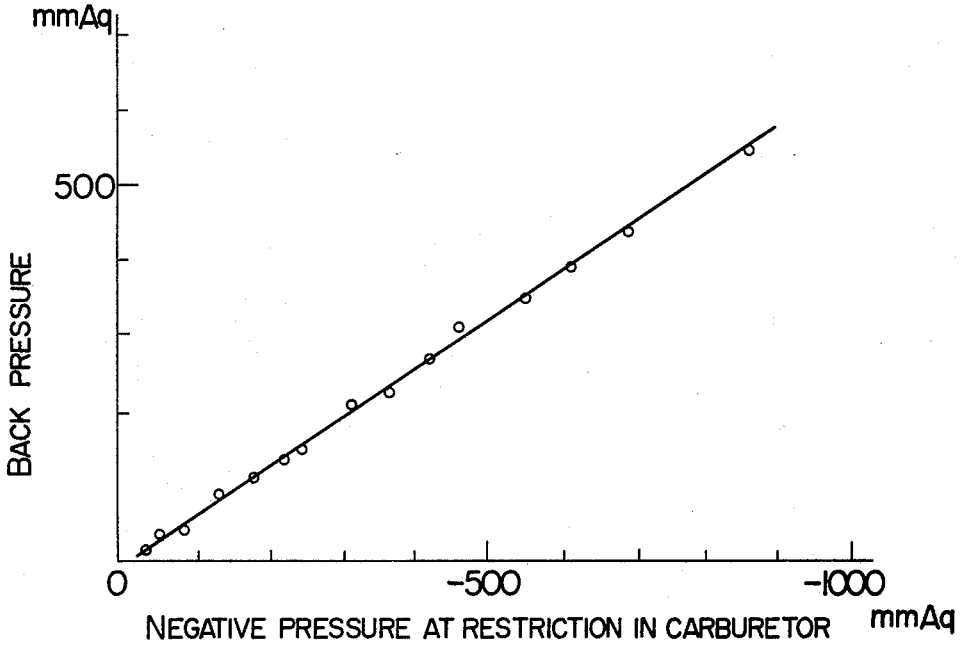
FIG. 8 shows the characteristic curve illustrating the relationship between the back pressure and the negative pressure at a restriction or venturi in a carburetor when an air pump in a secondary air supply system is not driven by an engine.
Figure 10:
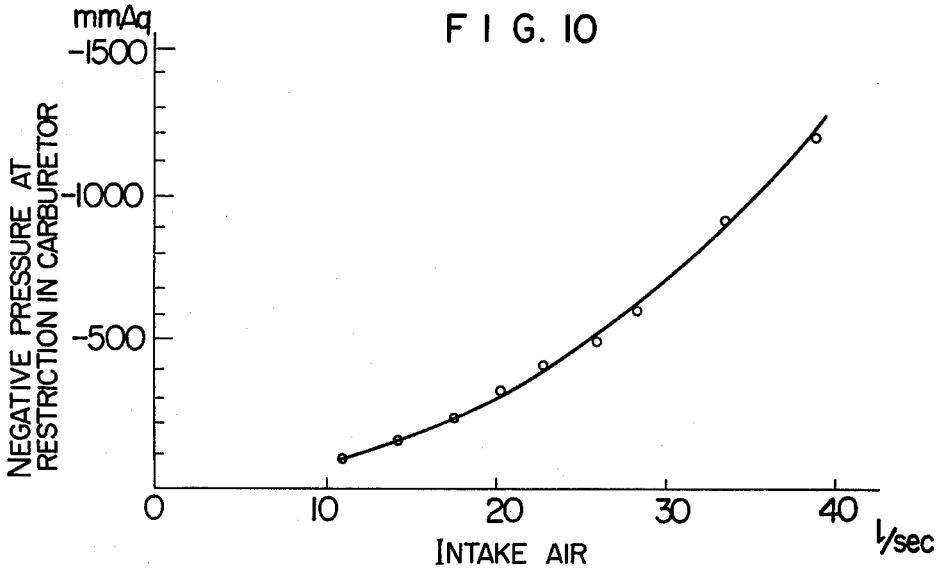
FIG. 10 shows the characteristic curve illustrating the relationship between the volume of intake air and the negative pressure at the venturi or restriction of the carburetor.

The characteristic curve illustrating this relation is shown in FIG. 10. The relation between the negative pressure at the venturi and the back pressure in an exhaust pipe is linear as shown in FIG. 8. When a part of the exhaust gas is recirculated from the exhaust system and injected into an intake system downstream of the venturi but upstream of a throttle valve, the volume of exhaust gas to be recirculated is in proportion to the volume of intake air.

Figure 9:
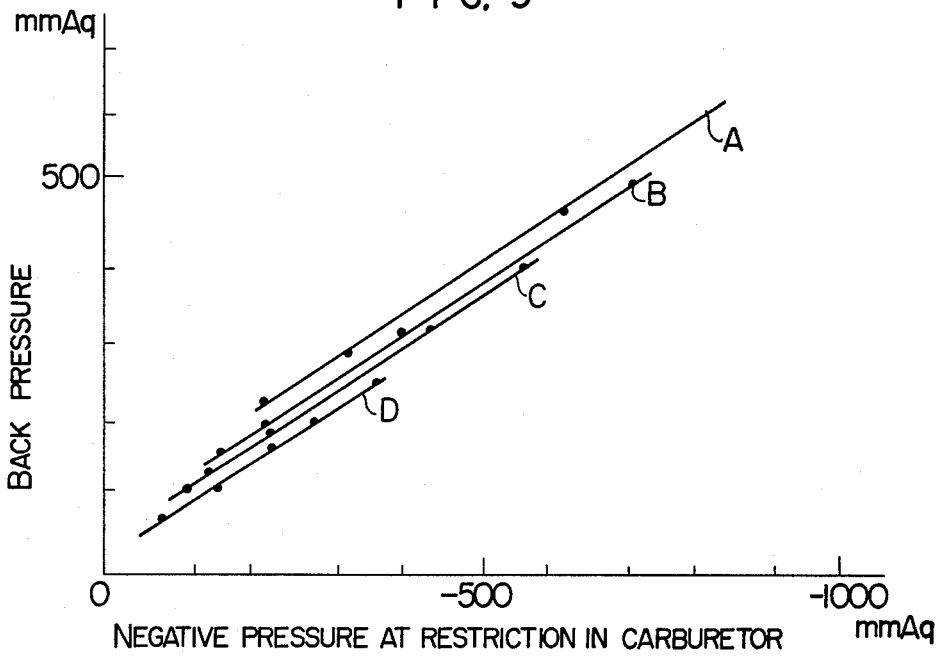
FIG. 9 shows the characteristic curves illustrating the relationship between the back and negative pressures when the air pump is driven by the engine.

However when an secondary air supply system incorporating an air pump driven by the engine is provided, the linearity of the relation between the negative pressure at the venturi of the carburetor and the back pressure in the exhaust system is considerably deviated as shown in FIG. 9 from the linearity shown in FIG. 8. That is, the volume of exhaust gas to be recirculated is not in proportion to the volume of intake air.

In FIG. 9, the curve A indicates the relation between the back pressure and the negative pressure at the venturi when the engine is driven at 2,500 r.p.m.; B, at 2,000 r.p.m.; C, at 1,500 r.p.m.; and D, at 1,000 r.p.m.

If the volume of exhaust gas to be recirculated is not in proportion to the volume of intake air, various problems arise as described previously so that the main object of the present invention is to provide an exhaust gas purifying device in which the volume of exhaust gas to be recirculated is in proportion to the volume of intake air.

FIRST EMBODIMENT, FIG. 1

Figure 1:
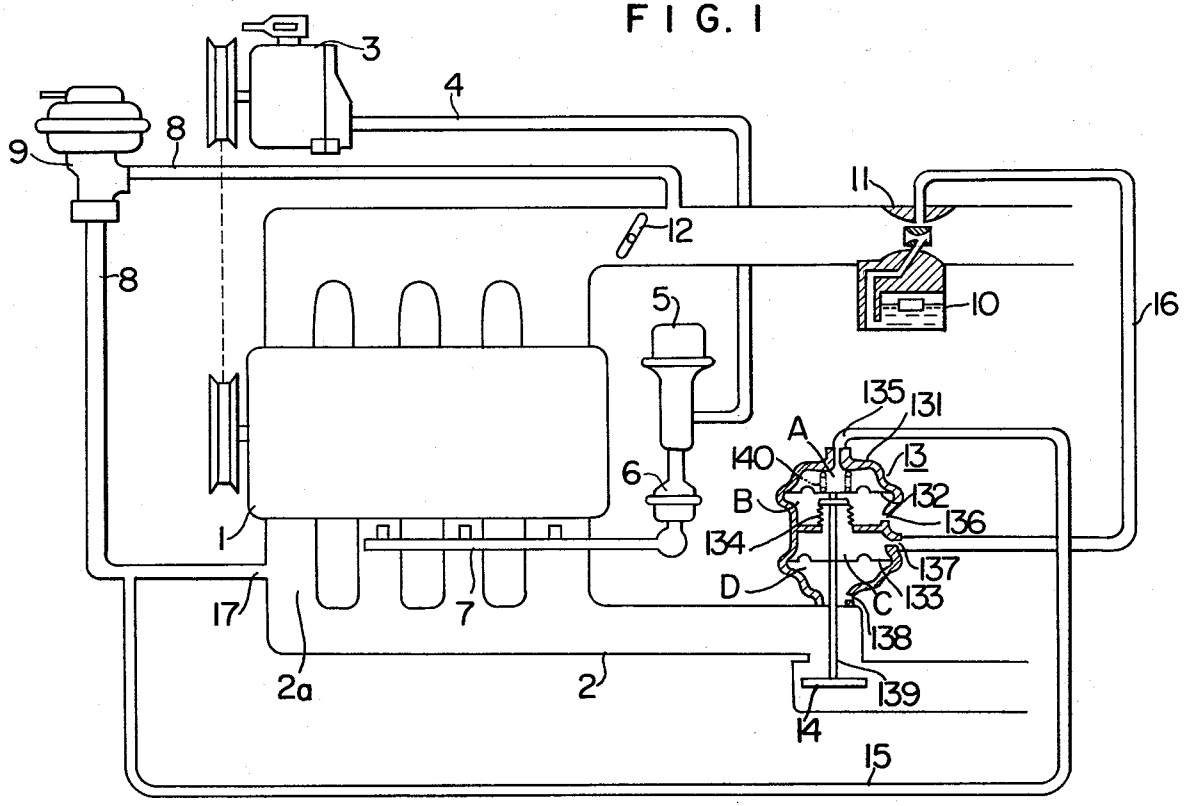
FIG. 1 is a schematic view of a first embodiment of the present invention.

In FIG. 1 there is shown a first embodiment of the present invention, wherein reference numeral 1 denotes an internal combustion engine; 2, an exhaust pipe; 3, an air pump drivingly coupled to the engine 1; 4, a secondary air supply pipe interconnecting the discharge port of the air pump 3 and an air bypass valve 5; 6, a check valve; and 7, an air injection nozzle having its one end connected to the check valve 6 and its nozzle holes opened into exhaust branches except a first exhaust branch **2*a* of the exhaust pipe 2. In this specification, the term "exhaust pipe" refers to a passage through which the exhaust gas discharged from the engine 1 is discharged into the surrounding atmosphere and the term "exhaust branch" refers to a branched section of the exhaust pipe between the exhaust port of each cylinder and the point where exhaust gases from respective cylinders are joined. Further referring to FIG. 1, reference numeral 8 denotes an exhaust gas recirculation pipe having its one end communicated with an exhaust gas intake port 17 opened into the first exhaust branch 2*a* and the other end opened into an air intake pipe downstream of a venturi 11 of a carburetor 10 but upstream of a throttle valve 12; 9, an EGR valve inserted in the exhaust gas recirculation pipe 8; 15, a back pressure sensing or tapping pipe having its one end communicated with the exhaust gas recirculation pipe 8 upstream of the EGR valve 9 and the other end communicated with a control means 13 which is a control valve adapted to be actuated in response to the pressure difference or the result of comparison between the pressures as will be described in detail hereinafter; 16, an intake air volume sensing pipe having its one end communicated with the throat of the venturi 11 and the other end communicated with the control valve 13; and 14, a variable restriction or throttle disposed in the exhaust pipe 2** for controlling the flow cross sectional area thereof.

Next still referring to FIG. 1, the control valve 13 will be describe in detail. The control valve 13 has a housing 131 which is divided by a first diaphragm 132, a second diaphragm 133 and a bellows 134 into four pressure chambers A, B, C and D which are referred to as "first, second, third and fourth pressure chambers", respectively. The first pressure chamber A is communicated through a back pressure intake port 135 and the back pressure sensing pipe 15 with the exhaust gas recirculation pipe 8. The second pressure chamber B is communicated with the surrounding atmosphere through an air vent 136; the third pressure chamber C is communicated with the tapping port opened at the venturi 11 through a negative pressure intake port 137 and the intake air volume sensing pipe 16; and the fourth pressure chamber D is communicated with the surrounding atmosphere through a second air vent 138. 139 is a shaft for integrally interconnecting the first and second diaphragms 132 and 133 and the bellows 134, and has the variable restriction 14 attached to the lower end. 140 is a spring loaded in the first pressure chamber A in such a way that the variable restriction 14 may be kept opened when no pressure is admitted into both the first and third pressure chambers A and C.

Next the mode of operation of the first embodiment with the above construction will be described. In the control valve 13, the back pressure is admitted into the first pressure chamber A through the back pressure sensing or tapping pipe 15 and the back pressure intake port 135; the atmospheric pressure is admitted into second pressure chamber B through the vent 136; the negative pressure at the venturi 11 is admitted into the third pressure chamber C through the intake volume sensing pipe 16 and the venturi negative pressure intake port 137; and the atmospheric pressure is admitted into the fourth pressure chamber D through the vent 138. The back pressure admitted into the first pressure chamber A tends to cause the first diaphragm 132 to deflect itself downwardly, thus displacing the variable restriction 14 downwardly in FIG. 1. The negative pressure at the venturi 11 acts on the second diaphragm 133 so that the variable restriction 14 is caused to shift upwardly. Therefore the position of the variable restriction 14 is dependent upon the balance between the back pressure, the negative pressure at the venturi and the force of the first spring 140, which is considerably small, however.

With increase in volume of intake air, the negative pressure at the venturi 11 increases so that the variable restriction 14 is caused to displace itself upwardly and consequently the flow cross sectional area of the exhaust pipe 3 is decreased with the result of increase in back pressure. On the other hand, when the volume of intake air is decreased so that the negative pressure at the venturi 11 is decreased accordingly, the variable restriction 14 is displaced downwardly so that the flow cross sectional area of the exhaust pipe 2 is increased with the resultant decrease in back pressure. In response to the excessive increase in back pressure the variable restriction 14 is displaced downwardly so that the flow cross sectional area is increased with the resultant decrease in back pressure. Further in response to the excessive decrease in back pressure the variable restriction 14 is displaced upwardly so that the flow cross sectional area is decreased with the resultant increase in back pressure. Thus when the variable restriction 14 is controlled in such a way that the signal representative of the volume of exhaust gas to be recirculated may be in proportion to the signal representative of volume of intake air, the volume of exhaust gas to be recirculated may be made proportional to the volume of intake air. This may therefore solve the problem of the conventional devices that the volume of exhaust gas to be recirculated is increased relative to the volume of intake air under light load so that the operation of the engine is adversely affected or the volume of exhaust gas to be recirculated is decreased relative to the volume of intake air under heavy load so that the removal of NOx may be adversely affected. The first embodiment of the present invention therefore may ensure the optimum recirculation of exhaust gas so that the content of NOx in exhaust gas may be minimized without any adverse effect on the operation of the engine.

According to the first embodiment, the secondary air is not injected into the first exhaust branch 2*a* so that no secondary air is entrained into the exhaust gas to be recirculated and consequently the air-fuel ratio set by the carburetor is not adversely affected at all. Furthermore even when the malfunction of the air pump 3 causes the variation in back pressure, the control valve 13 ensures always the recirculation of exhaust gas in optimum volume in proportion to the volume of intake air.

SECOND EMBODIMENT, FIGS. 2, 3 AND 4

Figure 2:
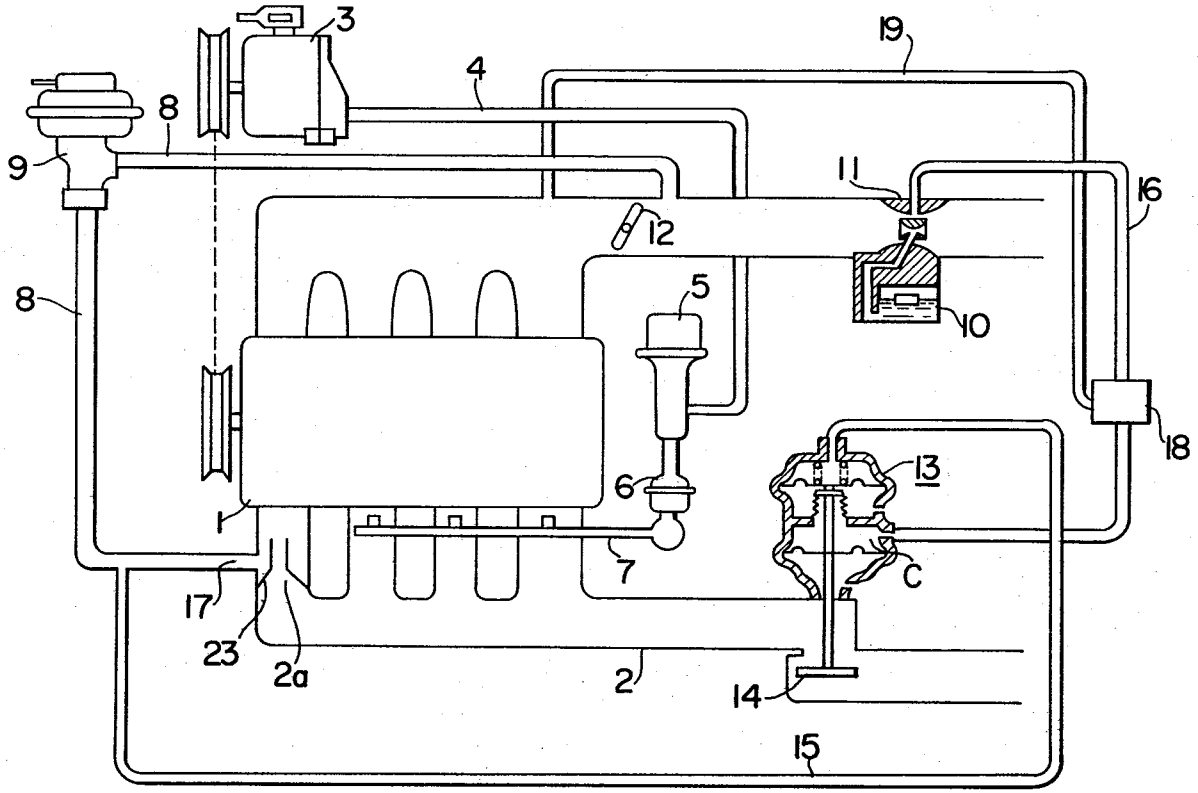
FIG. 2 is a schematic view of a second embodiment of the present invention.

In FIG. 2 there is shown a second embodiment of the present invention which is substantially similar in construction to the first embodiment described above except the additional provision of a pressure regulator 18 inserted in the negative pressure sensing or tapping pipe 16 for amplifying or attenuating the negative pressure admitted into the third pressure chamber C of the control valve 13, a pressure tapping pipe 19 for admitting the negative pressure downstream of the throttle valve 12 in the intake pipe into the pressure regulator 18, and a back-flowing preventive means 23 disposed in the first exhaust branch 2*a* downstream of the exhaust gas intake port 17 for preventing the flow of the exhaust gas containing the secondary air into the first exhaust branch 2*a* and to the port 17. Because of the provision of the pressure regulator 18, the optimum control of the position of the variable restriction 14 may be ensured even when the difference between the negative pressure at the venturi 11 and the back pressure is greatly increased. The pressure regulator 18 may be inserted into the back pressure sensing or tapping pipe 15.

Figure 3:
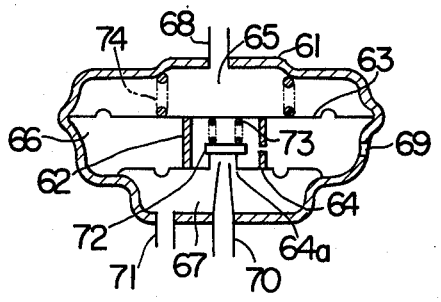
FIGS. 3 and 4 are sectional views of pressure regulators 18 which are used in conjunction with the second embodiment.

In FIG. 3 there is shown one example of the pressure regulator 18 which is an amplifier. It has a housing 61 which is divided by a first diaphragm 63 and a second diaphragm 64 which are interconnected with a pipe 62 into first, second and third pressure chambers 65, 66 and 67. The negative pressure at the venturi 11 is admitted through a first negative pressure tapping pipe 68 into the first pressure chamber 65 defined by the housing 61 and the first diaphragm 63. Admitted into the second pressure chamber 66 defined between the first and second diaphragms 63 and 64 is the atmospheric pressure through a vent or port 69. Admitted into the third pressure chamber 67 through a second negative pressure tapping pipe 70 is the negative pressure downstream of the throttle valve 12 in the intake pipe. The third pressure chamber 67 is also communicated through an outlet pipe 71 with the third pressure chamber C of the control valve 13. The second diaphragm 64 is formed at the center with an opening 64*a* which is in the form of an upwardly directed, short hollow cylinder in the second embodiment, and the second negative pressure pipe 70 is extended through the wall of the housing 61 and the third pressure chamber 67 into the opening 64*a*. A valve element 72 which is attached to the lower end of a spring 73 loaded in the second pressure chamber 66 is normally pressed against the opening 64*a* in opposed relation with the opening of the second negative pressure pipe 70. The first diaphragm 63 which is loaded with a spring 74 disposed in the first pressure chamber 64 has an effective pressure receiving area greater than the second diaphragm 64.

When the negative pressure at the venturi 11 which is admitted into the first pressure chamber increases, the first diaphragm 63 is caused to deflect upwardly against the spring 74, and so does the second diaphragm 64. As a result, the valve element 72 is displaced upwardly away from the upper end opening of the second negative pressure pipe 70 so that the negative pressure downstream of the throttle valve 12 in the intake pipe flows into the third pressure chamber 67 with the resultant increase in negative pressure in the third pressure chamber 67. When the negative pressure in the third pressure chamber 67 excessively increases or the venturi pressure (negative pressure) decreases the second diaphragm 64 is deflected downwardly so that the valve element 72 is pressed against the upper end opening of the second negative pressure pipe 70, interrupting the admission of the negative pressure into the third pressure chamber 67. When the valve element 72 is pressed against the upper end of the second negative pressure pipe 70, the further downward movement of the valve element 72 is limited. When the second diaphragm 64 is further deflected downwardly, the opening 64*a* of the second diaphragm 64 is moved away from the valve element 72 so that the atmospheric air is admitted through the opening 64*a* from the second pressure chamber 66 into the third pressure chamber 67 and consequently the negative pressure in the third pressure chamber 67 is decreased. Thus the negative pressure which is admitted from the third pressure chamber 67 into the third pressure chamber C of the control valve 13 is the negative pressure at the venturi 11 which is amplified by a factor depending upon the difference in area between the first and second diaphragms 63 and 64.

Figure 4:
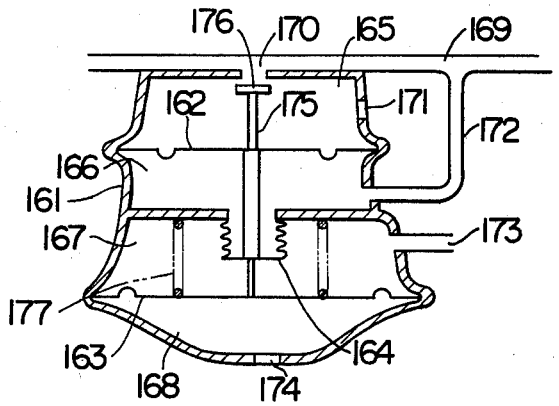

In FIG. 4, there is shown another example of the pressure regulator 18 which is an attenuator for attenuating the negative pressure at the venturi 11. It has a housing 161 which is divided by first and second diaphragms 162 and 163 and a bellows 164 into first, second, third and fourth pressure chambers 165, 166, 167 and 168. The first pressure chamber 165 defined by the housing 161 and the first diaphragm 162 is communicated not only with a negative pressure pipe 169 in communication with the intake pipe through a port 170 but also with the surrounding atmosphere through a vent 171. The second pressure chamber 166 is communicated through a negative pressure bypass pipe 172 with the negative pressure pipe 169. The third pressure chamber 167 is communicated through a negative pressure tapping pipe 173 with the pressure tapping opening at the throat of the venturi 11 of the carburetor 10 so that the negative pressure at the venturi 11 is admitted. The fourth pressure chamber 168 is communicated through a vent 174 with the surrounding atmosphere. The area of the first diaphragm 162 is smaller than the area of the second diaphragm 163, and the area of the bellows 164 is smaller than the area of the first diaphragm 162. The first and second diaphragms 162 and 163 and the bellows 164 are interconnected with a shaft 175 whose upper end is terminated into a valve 176 for opening or closing the communication port 170 between the first pressure chamber 165 and the negative pressure pipe 169. The second diaphragm 163 is loaded with a spring 177 so as to counter with the negative pressure at the venturi 11. The negative pressure pipe 169 is communicated with the third pressure chamber C of the control valve 13 (see FIG. 2).

The attenuator with the above construction compares the pressure admitted into the second pressure chamber 166 with the pressure admitted into the third pressure chamber 167, and causes the shaft 175 and hence the valve 176 to move away from the communication port 170 when the negative pressure in the second pressure chamber 166 is higher than the negative pressure in the third pressure chamber 167. As a result, the atmospheric air is introduced into the negative pressure pipe 169 whereby the negative pressure in the pipe 169 is decreased. When the negative pressure in the negative pressure pipe 169 decreases excessively, the shaft 175 is shifted upwardly under the pressure difference between the second and third pressure chambers 166 and 167 so that the valve 176 restricts the flow passage into the negative pressure pipe 169 of the atmospheric air. Thus the negative pressure admitted into the third pressure chamber C of the control valve 13 is attenuated relative to the negative pressure at the venturi 11 by a factor depending upon the difference in area between the first and second diaphragms 162 and 163.

The pressure regulator of the type shown in FIG. 3 or 4 may modified to amplify or attenuate the positive pressure and inserted into the back pressure sensing or tapping pipe 15.

THIRD EMBODIMENT, FIG. 5

Figure 5:
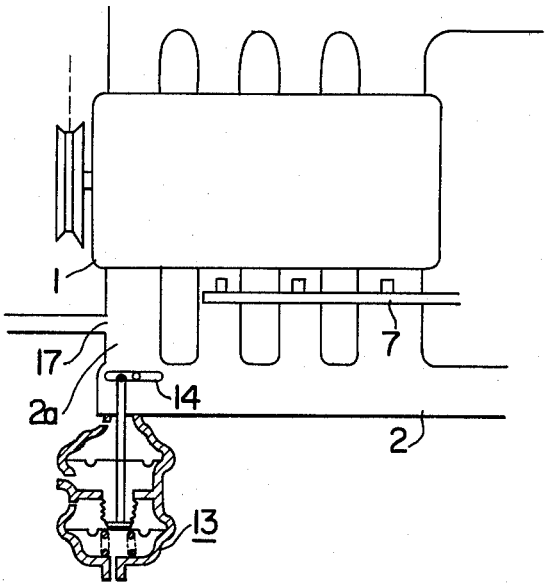
FIG. 5 is a schematic view, partly in section, of a third embodiment of the present invention.

In FIG. 5 there is shown a third embodiment of the present invention which is substantially similar in construction to the first or second embodiment except that the variable restriction 14 is disposed in the first exhaust branch 2*a* downstream of the exhaust intake port 17 but upstream of the junction of the branch 2*a* with a common section of the exhaust pipe 2. Therefore the back pressure only in the exhaust branch 2*a* is controlled so that the adverse effect on the engine 1 due to the increase in back pressure may be minimized. In the third embodiment the variable restriction 14 is shown as consisting of a butterfly valve, but it is to be understood that it may be of the poppet type as with the case of the first and second embodiments. Alternatively, the poppet valve type variable restriction 14 used in the first and second embodiments may be replaced with a butterfly type valve.

FOURTH EMBODIMENT, FIGS. 6 AND 7

Figure 6:
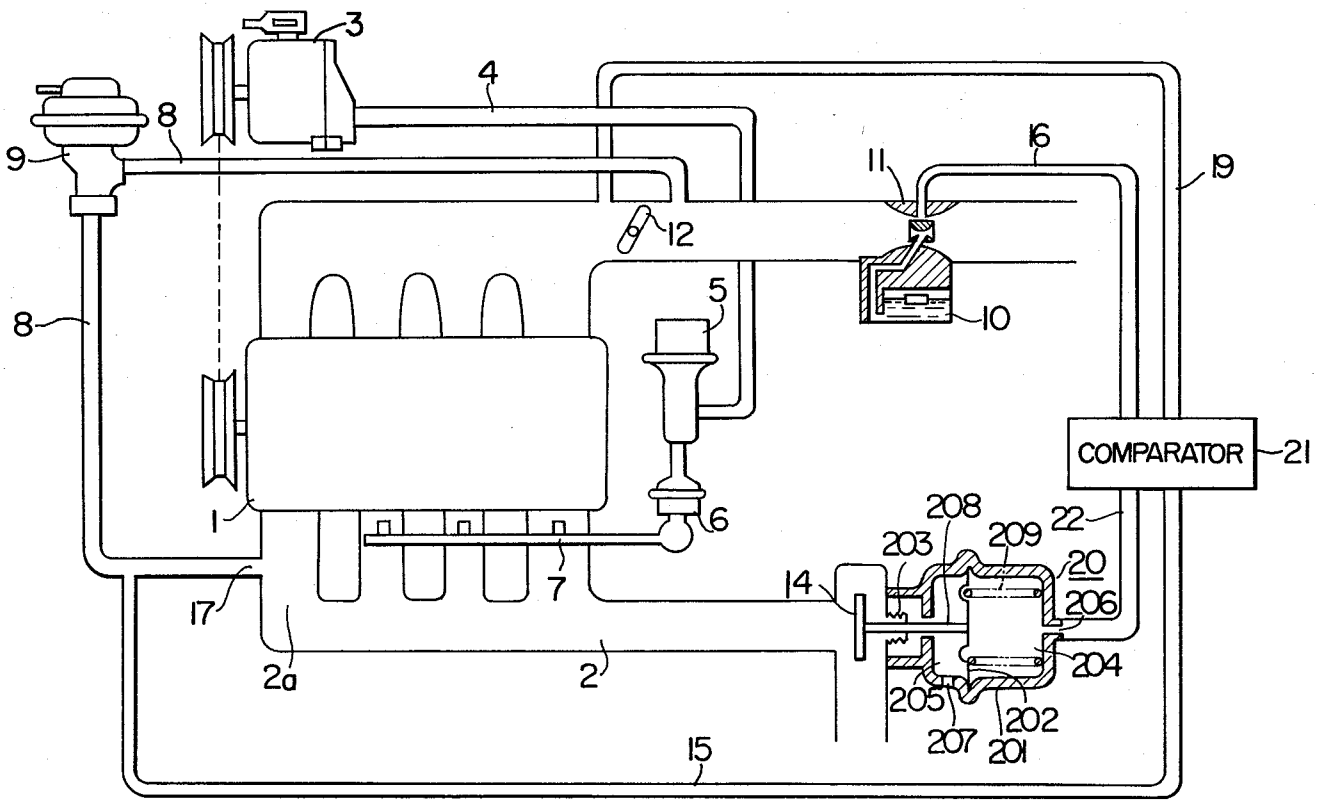
FIG. 6 is a schematic view, partly in section, of a fourth embodiment of the present invention.
Figure 7:
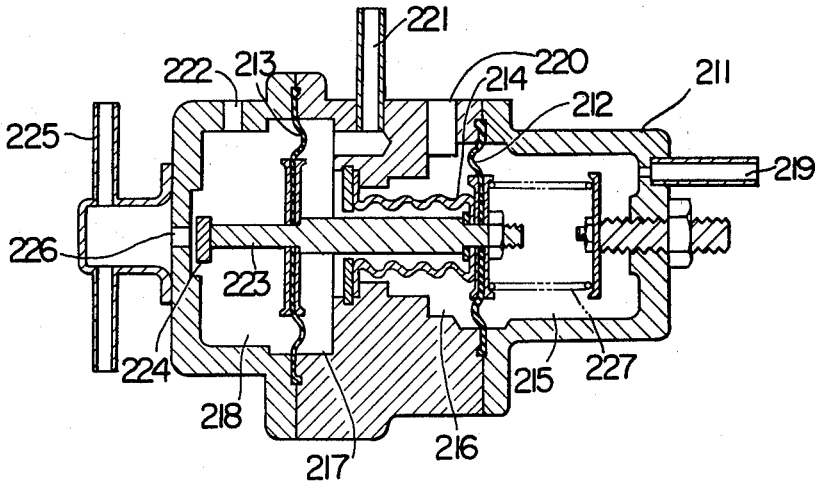
FIG. 7 is a sectional view of a comparator 20 used in conjunction with the fourth embodiment.

Whereas in the first embodiment, the control valve 13 which is actuated in response to the difference between the back pressure and the negative pressure at the venturi 11 directly controls the position of the variable restriction 14, in the fourth embodiment shown in FIGS. 6 and 7 the variable restriction 14 is controlled by an actuating valve 20 which in turn is actuated in response to the output signal from a comparator 21 which compares the negative pressure at the venturi 11 with the back pressure.

First referring to FIG. 7, the construction as well as the mode of operation of the comparator 21 will be described. It has a housing 211 which is divided into four pressure chambers 215, 216, 217 and 218 by a first diaphragm 212, a second diaphragm 213 and a bellows 214 interposed between them. The first pressure chamber 215 defined by the housing 211 and the first diaphragm 212 is communicated with the exhaust pipe 8 through a first pipe 219 and the back pressure sensing or tapping pipe 15 (See FIG. 6). Admitted into the second pressure chamber 216 defined by the housing 211, the first diaphragm 212 and the bellows 214 is the atmospheric pressure through a vent 220. Admitted into the third pressure chamber 217 defined by the housing 211, the second diaphragm 213 and the bellows 214 is the negative pressure at the venturi 11 through a second pipe 221 and the intake air volume sensing pipe 16 (see FIG. 6). Admitted into the fourth pressure chamber 218 defined by the housing 211 and the second diaphragm 213 is the atmospheric pressure through a vent 222. The first and second diaphragms 212 and 213 and the bellows 214 are interconnected with a shaft 223 whose one end is terminated into a valve 224 for opening or closing a communication port 226 between the fourth pressure chamber 218 and a third pipe 225. One end of the third pipe 225 is connected to the pressure tapping pipe 19 (see FIG. 6) so that the negative pressure of intake air downstream of the throttle valve in the intake pipe is admitted into the third pipe 225. The other end of the third pipe 225 is connected to an output pipe 22 of the comparator 21 (See FIG. 6). A range spring 227 is loaded in the first pressure chamber 215 for controlling the position of the valve 224 when the pressures in the first and third pressure chambers 215 and 217 become equal to the atmospheric pressure.

The back pressure admitted into the first pressure chamber 215 of the comparator 21 forces the first diaphragm 212 to the left in FIG. 7 or toward the second pressure chamber 216. The negative pressure at the venturi 11 which is admitted into the third pressure chamber 217 tends to cause the second diaphragm 213 to deflect itself toward the right or toward the bellows 214. The position of the shaft 223 and hence the valve 224 is therefore dependent upon the pressure difference between the pressures acting on the first and second diaphragms 212 and 213. When the negative pressure at the venturi 11 which is admitted into the third pressure chamber 217 increases when the back pressure and negative pressure are balanced as shown in FIG. 7, the shaft 223 and valve 224 are displaced to the right in FIG. 7 so that the atmospheric air flowing into the third pipe 225 through the communication port 226 is increased in volume with the resultant decrease in negative pressure in the third pipe 225. When the negative pressure at the venturi 11 decreases, the shaft 223 and valve 224 are displaced toward the left so that the flow passage into the third pipe 3 is reduced or completely closed, whereby the negative pressure in the third pipe 225 is increased. When the back pressure which is admitted into the first pressure chamber 215 increases excessively, the shaft 223 and valve 224 are displaced toward the communication port 226 to reduce or close the flow passage into the third pipe 225 so that the negative pressure therein is increased. In response to the excessive decrease in back pressure the valve 224 is moved away from the communication port 226 so that the atmospheric air flowing into the third pipe 225 is increased in volume and consequently the negative pressure in the third pipe 225 is decreased.

Next referring back to FIG. 6, the actuating valve 20 will be described. It has a housing 201 which is divided into two pressure chambers 204 and 205 by a diaphragm 202 and a sealing bellows 203 at one opening of the actuating valve 20 on the side of the exhaust pipe 2. The negative pressure which is controlled by the comparator 21 is admitted into the fifth pressure chamber 204 defined by the housing 201 and the diaphragm 202 through the pressure tapping pipe 19, the comparator 21, the output pipe 22 and a port 206. The atmospheric pressure is admitted through a vent 207 into the sixth pressure chamber 205 defined by the housing 201, the diaphragm 202 and the bellows 203. A stem 208 has its end connected to the diaphragm 202 and the other end terminated into the variable restriction 14, and a spring 209 is loaded in the fifth pressure chamber 204. The negative pressure admitted into the fifth pressure chamber 204 tends to cause the diaphragm 202 to displace itself to the right in FIG. 6, and the spring 209 counters the rightward movement of the diaphragm 202. Therefore the position of the variable restriction 14 is dependent upon the balance between the force of the spring 209 and the negative pressure acting on the diaphragm 202. When the force acting on the diaphragm 202; that is, the negative pressure multiplied by the area of the diaphragm 202 is greater than the force of the spring 209, the variable restriction 14 is displaced to the right so that the flow cross sectional area of the exhaust pipe 2 is increased with the resultant decrease in back pressure. On the other hand, when the spring 209 overcomes the negative pressure acting on the diaphragm 202, the variable restriction 14 is displaced to the left to reduce the flow cross sectional area of the exhaust pipe 2, resulting in the increase in back pressure.

Next referring to FIGS. 6 and 7, the mode of operation of the fourth embodiment incorporating the actuating valve 20 and the comparator 21 will be described. It is assumed that in the state shown in FIG. 6 the signal representative of intake air volume is in proportion to the signal representative of the back pressure. With increase in volume of intake air, the negative pressure at the venturi 11 increases so that the negative pressure to be admitted into the fifth pressure chamber 204 of the actuating valve 20 is decreased by the comparator 21 so that the variable restriction 14 is displaced toward the left and consequently the back pressure is increased. On the other hand, with decrease in volume of intake air, the negative pressure at the venturi 11 decreases and consequently the back pressure decreases accordingly. In response to the excessive increase in back pressure, the comparator 21 increases the negative pressure to be admitted into the fifth pressure chamber 204 of the actuating valve 20 so that the variable restriction 14 is displaced to the right with the resultant decrease in back pressure. On the other hand, when the back pressure is decreased excessively, the negative pressure to be admitted into the fifth pressure chamber 204 is decreased so that the variable restriction 14 is displaced to the left with the resultant increase in back pressure.

Thus the volume of exhaust gas to be recirculated may be made proportional to the volume of intake air by controlling the variable restriction 14 in such a way that the signal representative of the volume of exhaust gas to be recirculated may be proportional to the signal representative of the volume of intake air. In general, relatively great force is required for controlling the position of the restriction 14 which is disposed within the exhaust pipe 2, but the easy position control of the variable restriction 14 can be attained in accordance with the present invention because the negative pressure in the intake pipe which has relatively a high magnitude is used and controlled by the comparator so that the actuating valve 20 may control the position of the variable restriction 14 in response to the output signal from the comparator 21. Thus the optimum control of back pressure may be ensured.

In the preferred embodiments described above, the negative pressure at the venturi in the carburetor is used as the signal representative of the volume of intake air, but it will be understood that the output signal from a conventional detector for detecting the volume of intake air may be also used.

In summary, the variable restriction is disposed downstream of the exhaust gas intake port in the exhaust pipe and control means is provided for controlling the position of the variable restriction in such a way that the signal representative of the volume of exhaust gas may be proportional to the signal representative of the volume of intake air, whereby the volume of exhaust gas to be recirculated may be optimumly proportional to the volume of intake air. As a result, the content of NOx in the exhaust gas may be minimized; the engine performance may be improved; and the optimum recirculation of exhaust gas may be ensured. Furthermore the adverse effects on the operation of the engine due to the increase in back pressure may be substantially eliminated by the provision of the variable restriction in one of the exhaust branches which is communicated through the exhaust gas intake port with the exhaust gas recirculation system for controlling the back pressure only in this exhaust branch.

Furthermore means for preventing the back-flowing of the exhaust gas mixed with the secondary air may be disposed in the exhaust branch which is communicated through the exhaust gas intake port with the exhaust gas recirculation system and into which is not injected the secondary air so that the entrainment of the secondary air into the exhaust gas to be recirculated may be minimized and consequently the adverse effects on the fuel-air ratio set by the carburetor may be eliminated.

What is claimed is:

1. In an exhaust gas purifying device for use with an internal combustion engine of the type comprising a secondary air supply system for supplying the secondary air into an exhaust system of the engine, and an exhaust gas recirculation system for recirculating a portion of exhaust gas in the exhaust system through an exhaust gas intake port and an exhaust gas recirculation passage into an intake system of the engine, an improvement comprising:

(a) variable restriction means disposed in said exhaust system downstream of said exhaust gas intake port for varying flow cross sectional area of said exhaust system, and (b) control means for comparing a signal representative of the volume flow rate of recirculated exhaust gas with a signal representative of the volume flow rate of intake air and controlling said variable restriction means in such a way that said signal representative of the volume flow rate of recirculated exhaust gas is made proportional to said signal representative of the volume flow rate of intake air.

2. An improvement as set forth in claim 1, wherein said exhaust system has a plurality of exhaust branches each of which is communicated with each of the cylinders of the engine.

said exhaust gas intake port is communicated with one of said exhaust branches, and said variable restriction means is disposed in said one exhaust branch downstream of said exhaust gas intake port but upstream of the junction of said one exhaust branch with the remaining exhaust branches.

3. An improvement as set forth in claim 1, wherein said exhaust system has a plurality of exhaust branches each of which is communicated with each of the cylinders of the engine and at least one of which is not supplied with the secondary air, said exhaust gas intake port is communicated with said one exhaust branch, and back-flowing preventive means is disposed in said one exhaust branch downstream of said exhaust gas intake port but upstream of the junction of said one exhaust branch with the remaining exhaust branch for preventing the flow of the exhaust gas from said remaining exhaust branches into said one exhaust branch and said exhaust gas intake port.

4. An improvement as set forth in claim 1, wherein said signal representative of the volume of exhaust gas is a back pressure produced in said exhaust system, and the signal representative of the volume of intake air is the negative pressure at a venturi in a carburetor of said engine.

5. An improvement as set forth in claim 4, wherein said control means includes a control shaft operatively coupled to said variable restriction means, said control shaft being adapted to be displaced in one direction in proportion to said back pressure and in the other direction in proportion to said negative pressure at the venturi to thereby control said variable restriction means so as to increase or decrease the flow cross sectional area of said exhaust system.

6. An improvement as set forth in claim 5, wherein said control means comprises (a) a housing, (b) a first diaphragm, a bellows and a second diaphragm disposed within said housing in the order named and spaced apart from each other by a suitable distance to define first, second, third and fourth pressure chambers, (c) said back pressure being admitted into said first pressure chamber, (d) the atmospheric pressure being admitted into said second and fourth pressure chambers, (e) said negative venturi pressure being admitted into said third pressure chamber, and (f) said control shaft interconnecting said first diaphragm, said bellows and said second diaphragm.

7. An improvement as set forth in claim 6, wherein pressure regulator means is inserted into a pressure tapping pipe for transmitting said negative pressure at the venturi into said third pressure chamber of said control means for amplifying or attenuating said negative pressure.

8. An improvement as set forth in claim 7, wherein said pressure regulator means comprises (a) a housing, (b) first and second diaphragms disposed within said housing to divide said housing into first, second and third pressure chambers, (c) said negative venturi pressure being admitted into said first pressure chamber defined by said housing and said first diaphragm, (d) the atmospheric pressure being admitted into said second pressure chamber defined by said housing and said first and second diaphragms, (e) said third pressure chamber defined by said housing and said second diaphragm being communicated with said third pressure chamber of said control means, (f) the effective area of said second diaphragm being smaller than the effective area of said first diaphragm, (g) said second diaphragm being formed with a center opening, (h) a member for interconnecting said first and second diaphragms, (i) spring means disposed within said first pressure chamber for normally biasing said first diaphragm to said second pressure chamber, p1 (j) valve means attached to the lower end of spring means loaded in said second pressure chamber for normally closing said center opening of said second diaphragm, and (k) a negative pressure pipe having its one end communicated with an intake system of the engine downstream of said venturi and the other end extended into said third pressure chamber and normally spaced apart from said valve means by a predetermined distance, said the other end being closed by said valve means when said second diaphragm is deflected toward said third pressure chamber, said center opening of said second diaphragm being opened to intercommunicate said second and third pressure chambers when said second diaphragm is further deflected toward said third pressure chamber with the downward movement of said valve means prevented by the engagement thereof with said the other end of said negative pressure pipe.

9. An improvement as set forth in claim 7, wherein said third pressure chamber of said control means is communicated with an intake system of the engine downstream of said venturi through a negative pressure pipe, said pressure regulator means comprises (a) a housing, (b) a first diaphragm, a bellows and a second diaphragm disposed in said housing for defining therein first, second, third and fourth pressure chambers, (c) the atmospheric pressure being admitted into said first chamber defined by said housing and said first diaphragm, said first chamber being communicated with said negative pressure pipe through a communication port, (d) said second pressure chamber defined by said housing and said first diaphragm and said bellows being communicated with said negative pressure pipe upstream of said communication port of said first pressure chamber, (e) said negative pressure at said venturi being admitted into said third pressure chamber defined by said housing and said second diaphragm and said bellows, (f) the atmospheric pressure being admitted into said fourth pressure chamber defined by said housing and said second diaphragm, (g) the effective area of said first diaphragm being smaller than the effective area of said second diaphragm, (h) the effective area of said bellows being smaller than the effective area of said first diaphragm, (i) spring means disposed in said third pressure chamber for normally biasing said second diaphragm toward said fourth pressure chamber, (j) a shaft for interconnecting said first diaphragm and said bellows and said second diaphragm, and (k) valve means attached to the end of said shaft extended into said first pressure chamber for movement toward or away from said communication port in response to the displacement of said first and second diaphragms and said bellows, thereby controlling the flow passage from said first pressure chamber through said communication port into said negative pressure pipe.

10. An improvement as set forth in claim 4, wherein said control means comprises a comparator for comparing the back pressure with said negative pressure at the venturi in said carburetor and generating the negative pressure signal representative of the difference between said back and negative pressures, and an actuating means responsive to said negative pressure signal from said comparator for controlling the position of said variable restriction means;

said comparator comprises a housing, a first diaphragm, a bellows and a second diaphragm disposed in said housing and spaced apart from each other by a suitable distance to define first, second, third and fourth pressure chambers in said housing, said back pressure being admitted into said first pressure chamber, the atmospheric pressure being admitted into said second pressure chamber, said negative pressure at the venturi being admitted into said third pressure chamber, said fourth pressure chamber being communicated not only with the surrounding atmosphere but also through a communication port with a negative pressure pipe intercommunicating the intake system of the engine and said actuator, a shaft for interconnecting said first diaphragm, said bellows and said second diaphragm, and valve means attached to the end of said shaft extended into said fourth pressure chamber for movement toward or away from said communication port for controlling the flow passage from said fourth chamber through said communication port into said negative pressure pipe.

11. In an exhaust gas purifying device, for use with an internal combustion engine, of the type comprising an exhaust gas recirculation system for recirculating a portion of exhaust gas in an exhaust system of the engine through an exhaust gas intake port and an exhaust gas recirculation passage into an intake system of the engine, an improvement comprising (a) variable restriction means disposed in said exhaust system downstream of said exhaust gas intake port for varying back pressure in said exhaust system to thereby control the volume of exhaust gas to be recirculated into said intake system, (b) means for detecting the volume flow rate of intake air to said engine, (c) means for detecting the back pressure in said exhaust system, and (d) control means operatively connected to said variable restriction means for comparing the back pressure with a signal representative of the volume flow rate of intake air and controlling said variable restriction means in such a way that the volume flow rate of exhaust gas to be recirculated is made porportional to the volume flow rate of intake air.

12. An improvement as set forth in claim 11, wherein said signal representative of the volume flow rate of intake air is the negative pressure at a venturi in a carburetor of said engine, and said control means control said variable restriction means in such a way that the back pressure in said exhaust system is made proportional to the negative pressure in said venturi.

13. An improvement as set forth in claim 6, wherein pressure regulator means is inserted into a pressure tapping pipe for transmitting said back pressure to said first pressure chamber for amplifying or attentuating said back pressure.

* * * * *